US006058859A

United States Patent [19]

Colosimo, Jr.

[11] Patent Number: 6,058,859

[45] Date of Patent: May 9, 2000

[54] REFRACTORY SUPPORT DEVICE AND ASSOCIATED METHOD

[76] Inventor: Samuel A. Colosimo, Jr., 204 Constance Dr., McKees Rocks, Pa. 15136

[21] Appl. No.: 09/198,084

[22] Filed: Nov. 23, 1998

[51] Int. Cl.[7] ..... E04B 1/38; F27B 17/00

[52] U.S. Cl. ..... 110/332; 110/339; 110/341; 248/228.1; 52/713; 52/715; 52/747.13; 52/378; 264/30; 432/252

[58] Field of Search ..... 110/332, 331, 110/339, 341; 264/30; 432/252; 248/228.1, 228.2, 223.41, 224.61, 224.8, 229.1; 52/713–715, 747.13, 378, 326, 331, 333, 338

[56] References Cited

U.S. PATENT DOCUMENTS

| | | | |
|---|---|---|---|
| 1,674,210 | 6/1928 | Loucks | 52/714 X |
| 2,819,693 | 1/1958 | Rath . | |
| 3,056,362 | 10/1962 | Hosbein et al. . | |
| 3,958,519 | 5/1976 | Merkle, Jr. | 248/228.1 X |
| 4,317,418 | 3/1982 | Courshon, Jr. et al. | 110/331 |
| 4,473,983 | 10/1984 | Vance | 52/378 |
| 4,892,046 | 1/1990 | Gillespie | 110/332 |
| 4,908,915 | 3/1990 | Ruggles et al. | 52/714 X |

*Primary Examiner*—Robert Canfield
*Attorney, Agent, or Firm*—Michael D. Lazzara; Eckert Seamans Cherin & Mellott, LLC

[57] ABSTRACT

A device for supporting refractory material in a furnace environment is provided. In one embodiment, the supporting device is fabricated from individual pieces which are connected to produce a functional supporting device. The material supporting device provides an inverted channel-shaped base member structurally interengaged with a C-shaped member to provide support to material loads in an industrial setting. The C-shaped member has a pair of generally upwardly and inwardly projecting engagement flanges which provide interconnection with the base member. The base member has a pair of generally downwardly and inwardly projecting base flanges which provide support for refractory material. In another embodiment, interengagement between the C-shaped member and the base member may be further secured by conventional mechanical fastening apparatus and methods. A method of employing the above-described device and a method for using multiple supporting devices with one or more structural members are also disclosed.

27 Claims, 4 Drawing Sheets

REFRACTORY SUPPORT DEVICE AND ASSOCIATED METHOD

BACKGROUND OF THE INVENTION

1. Field of the Invention

The present invention relates generally to an apparatus and method for supporting material on an independent support structure. The present invention relates more specifically to a multi-piece apparatus and associated method, with the apparatus being structured to support refractory material in conjunction with overhead support structures such as, for example, I-beams.

2. Description of the Prior Art

For certain industrial applications, such as furnace construction, refractory anchors are required to maintain the physical structure of the furnace and to support the refractory in the desired position to resist heat loss from the furnace. The conventional refractory anchor extends from its "hot face", or the portion exposed to the heat of the furnace, to its "cold face", or the portion of the refractory anchor which faces the exterior of the furnace. It has been known to employ an apparatus, such as a metal hanger, to attach and support the refractory anchor to supporting steel work, such as an I-beam, for example.

It has been generally well-known to suspend a refractory anchor by some apparatus which when connected to a support structure such as an I-beam, for example, enables support of the refractory anchor in an industrial application such as furnace construction. It has also been known in industrial application to provide such a hanger which is a single-piece, unitary casting for the purpose of supporting a refractory anchor in place within the concrete ceiling of an industrial furnace. It has also been known to utilize welded assemblies in industrial construction.

Conventional castings used for holding and supporting refractory anchors, however, are typically uneconomical and generally require longer lead times for production and delivery of the castings to end users. These conventional castings are also susceptible to stress fractures occasioned by the expanding and contracting forces of a furnace structure undergoing temperature changes. These conventional castings may not be readily suited to adapt to variations in support structure dimensions.

What has not been present in the prior art is a device for supporting materials, such as refractories, which is economical to manufacture and which can be produced and delivered within a substantially reduced time cycle. There remains a real and substantial need for a material support device which resists stresses and fractures caused by the expanding and contracting forces generated by temperature changes in an industrial furnace. There is also a need for a material support device which will minimize the waste of economic resources and the lead time production problems associated with conventional support device design. There also remains a need for a material support device which can be economically produced and assembled in a variety of sizes to accommodate variations in support structure dimensions.

SUMMARY OF THE INVENTION

The refractory material support device of the present invention has met or exceeded the shortcomings of prior art devices provided for supporting refractory material.

The device for supporting refractory material of the present invention comprises an inverted channel-shaped base member which terminates on both of its sides in a pair of base flanges. A pair of flange openings are provided within the upper portion of the base member and are suitably sized to receive a C-shaped member. The C-shaped member has a pair of engagement flanges which, when inserted into the flange openings of the base member, extend through the openings generally upwardly and inwardly and are structured to receive a pair of support flanges of an I-beam. In this structural arrangement, the pair of I-beam support flanges are releasably inserted and then positioned between the engagement flanges of the C-shaped member and the upper portion of the inverted channel base member.

In production, the inverted channel-shaped base member and the C-shaped member are fabricated as separate components. In production or construction of the material support device, the engagement flanges of the C-shaped member are inserted through the pair of flange openings which are disposed within the upper portion of the base member. The engagement flanges of the C-shaped member are suitably formed to provide a non-releasable engagement between the C-shaped member and the base member. The structural interengagement between the C-shaped member and the base member is configured such that a pair of support flanges on an I-beam may be releasably inserted into a recess formed between the engagement flanges of the C-shaped member and the upper portion of the base member. Additionally, the body portion of the C-shaped member provides a force bearing surface designed for intimate contact against an inner surface of the base member to provide support when a load or refractory material is supported on the base flanges of the base member, which depend generally downwardly and inwardly from the base member.

In another embodiment of the present invention inner surface portions of the base member and C-shaped member may also be further connected and reinforced in their connection by any conventional mechanical apparatus or method, such as by welding, or by fasteners like rivets, nuts and bolts, and screws, for example. These conventional mechanical apparatus and methods may be employed in addition to the embodiment of the present invention which utilizes spaced openings to join the C-shaped member to the base member.

In method embodiments of the present invention, methods for supporting at least one refractory anchor on a single I-beam or a plurality of I-beams are provided. This method comprises providing a plurality of refractory material supporting devices maintained on at least one support structure such as an I-beam and using this plurality of devices for a structural application such as supporting the ceiling of an industrial furnace.

It is an object of the present invention to provide a readily assemblable refractory support device which exhibits flexibility of dimensioning and structural integrity in its application.

It is an object of the present invention to provide a support structure which will resist the contraction and expansion of an industrial furnace throughout its operational temperature changes.

It is an object of the present invention to provide flexibility in the production and assembly of material support devices to accommodate a variety of support structure dimensions.

It is an object of the present invention to provide a multi-piece fabricated device for supporting material.

It is an object of the present invention to provide a more economical and cost effective device for supporting refractory material in a furnace environment.

It is an object of the present invention to provide substantial advantages over conventional single-piece casting support devices.

It is an object of the present invention to reduce substantially reduces the cost and production time for each manufactured and formed support device.

It is an object of the present invention to provide a shorter lead time and facilitate a more efficient production process for providing and forming a device for supporting refractory material.

These and other objects of the present invention will be more fully understood from the following description of the invention on reference to the illustrations appended hereto.

DETAILED DESCRIPTION OF THE INVENTION

As used herein, "refractory material" is defined as a thermally insulative assembly or component supported by the material support device of the present invention.

As used herein, the term "I-beam" is defined to mean any elongated structural support members, including H-beams, which have a web portion and a pair of flanges.

The material support device of the present invention is preferably used in industrial furnaces such as a furnace employed in metal processing.

Figure 1:
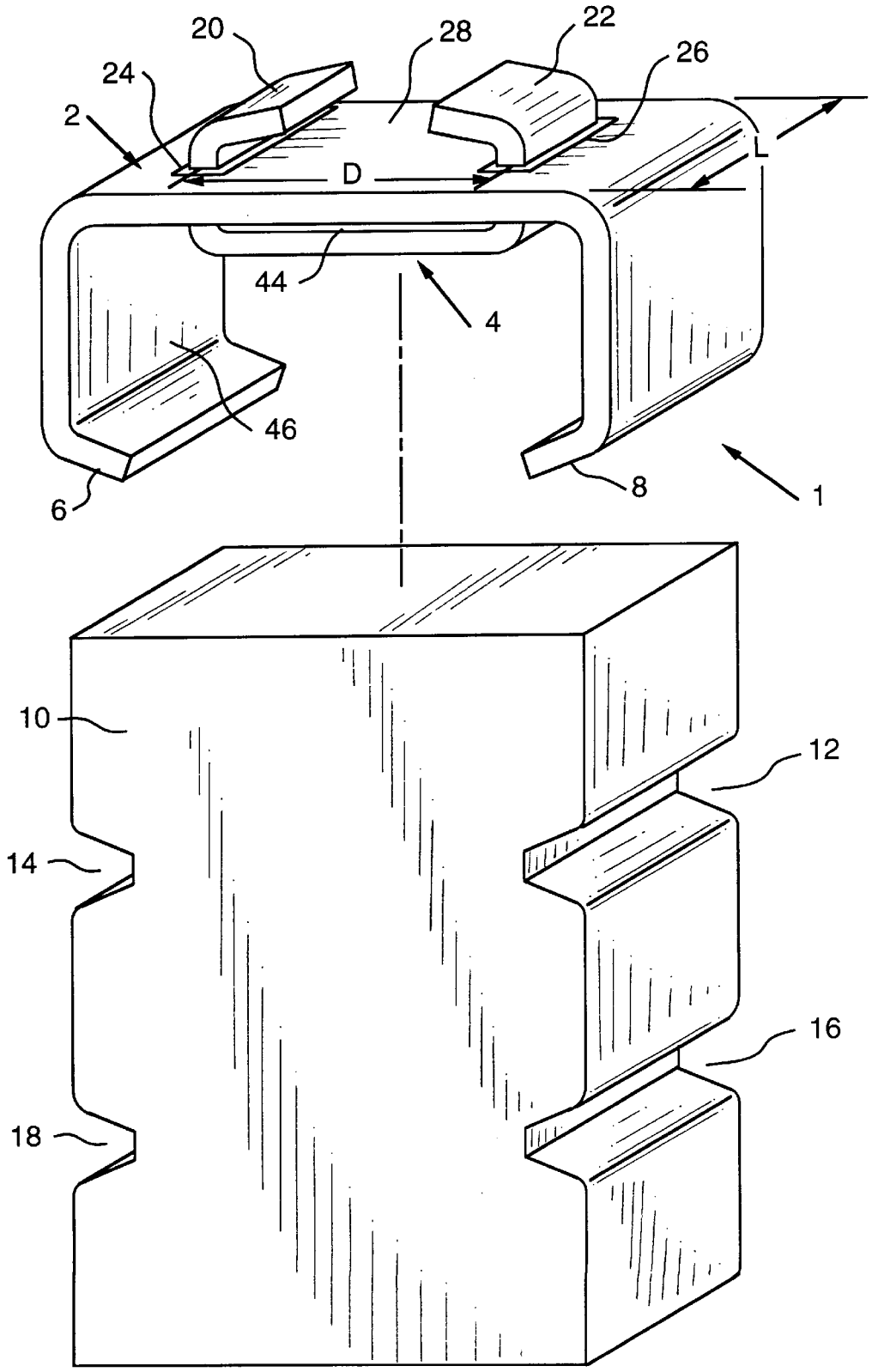
FIG. 1 is an exploded perspective view of the material supporting device of the present invention.
Figure 2:
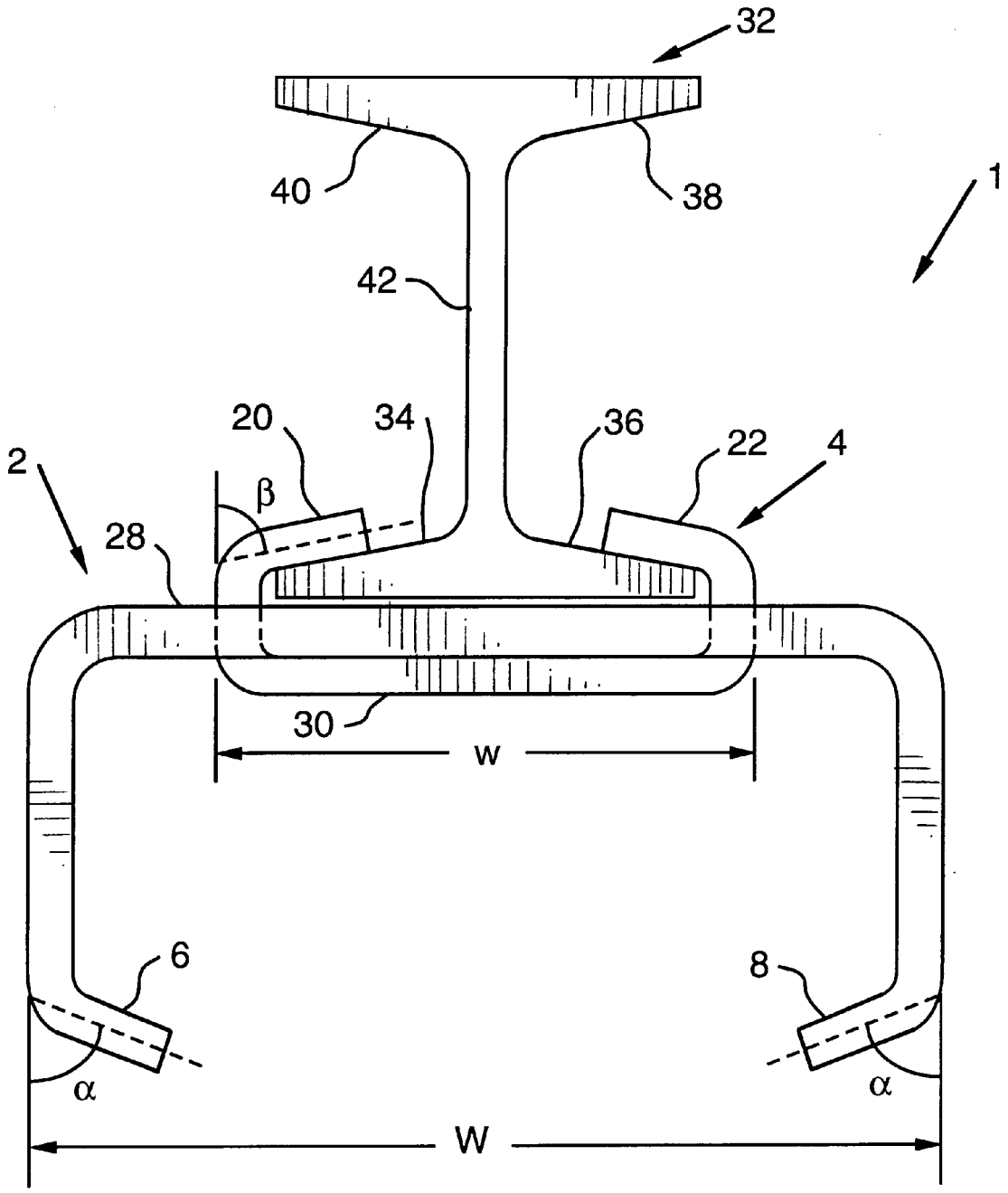
FIG. 2 is a front elevational view of the present invention depicting the structural interengagement of the base member and the C-shaped member of the present invention.
Figure 3:
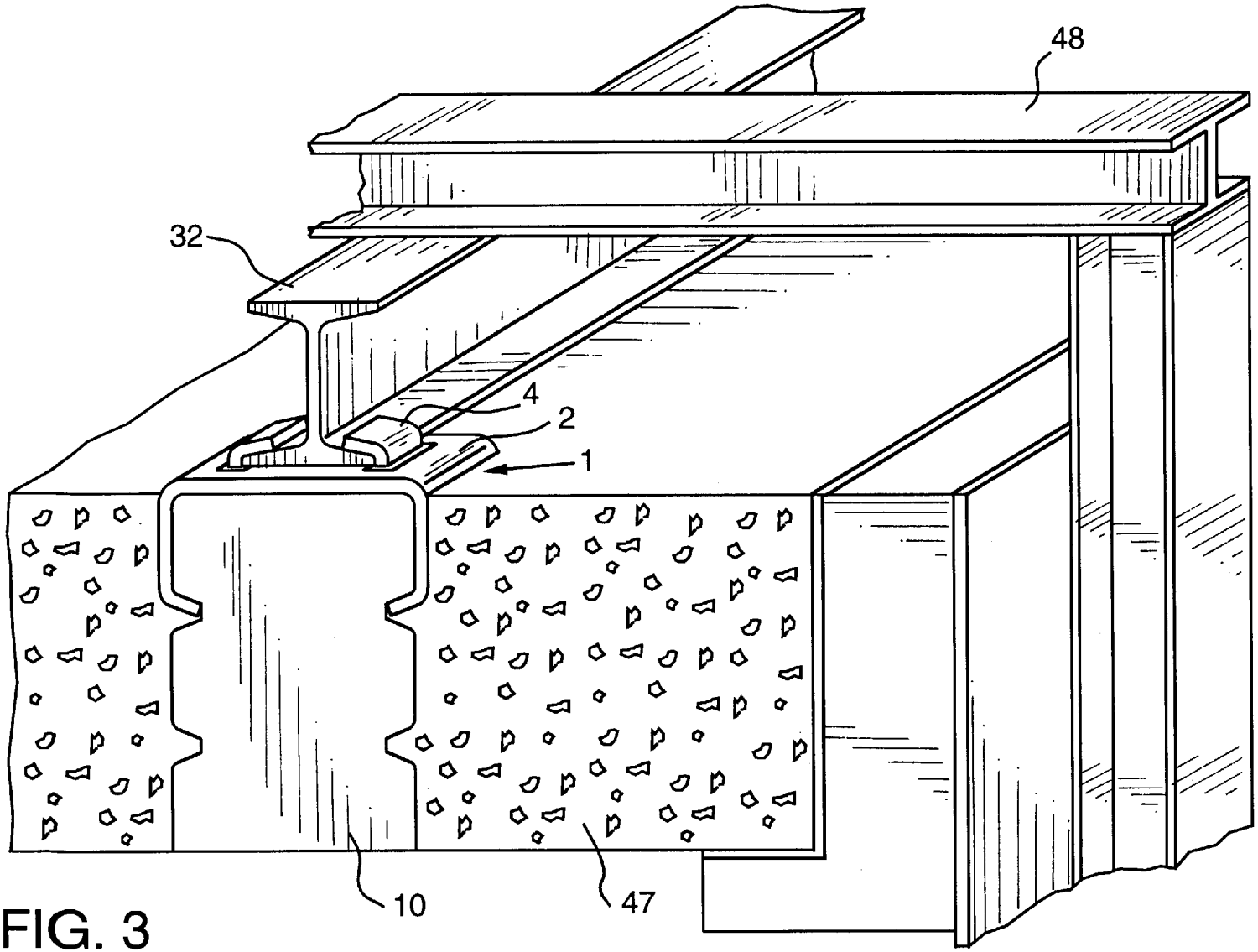
FIG. 3 is a perspective view of the present invention supporting refractory material in the ceiling of a furnace.

Referring now to FIGS. 1 and 2, a device 1 for supporting refractory material of the present invention is provided. The refractory material supporting device 1 comprises an inverted channel-shaped base member 2 structurally interengaged with a C-shaped member 4. The base member 2 has a pair of base flanges 6,8 which project generally downwardly and inwardly at an angle $\alpha$ with respect to vertical and which are suitably dimensioned and structured to receive a heavy industrial load such as refractory anchor 10. The refractory anchor 10 may have pairs of longitudinal recesses 12,14 and 16,18 formed therein which are suitably complementary for receiving base flanges 6,8 of base member 2. Securement of the refractory anchor 10 to the base member 2 provides a basis for subsequently supporting refractory material 47 (FIG. 3).

Referring now to FIGS. 1 and 2, in its final construction, the C-shaped member 4 terminates in a pair of engagement flanges 20,22 which project generally upwardly and inwardly at an angle $\beta$ with respect to vertical through a pair of flange openings 24,26 which may be defined in the upper portion 28 of base member 2. The flange openings 24,26 define a distance D with respect to the respective centerlines of each of the flange openings 24,26. The base member 2 may also have a length L as shown in FIG. 1. The C-shaped member 4 may also be provided with a base wall 30.

Referring again to FIGS. 1 and 2, I-beam 32 has integral flanges 34,36,38,40 and a web 42. The I-beam 32 is substantially longitudinally continuous. In an operational attachment of the refractory material support device 1, the flanges 34,36 of the I-beam 32 may be removably inserted through a recess established between the pair of engagement flanges 20,22 of C-shaped member 4 and the upper portion 28 of inverted channel-shaped base member 2. Although, the insertion of I-beam 32 into this recess may result in a non-permanent connection between inner portion 44 of C-shaped portion 4 and inner portion 46 of base member 2. This non-permanent connection permits relative movement between C-shaped member 4 and base member 2 which may be caused by expansion and contraction of an industrial furnace.

Referring again to FIGS. 1 and 2, in operation, the support flanges 34,36 of I-beam 32 intimately bear against the inner surface 44 of engagement flanges 20,22 to provide support between the I-beam 32 and the device 1 for supporting refractory material when flanges 34,36 of I-beam 32 are inserted in releasable connection with C-shaped member 4. Additionally, in operation, a portion of inner surface 44 of the C-shaped member 4 bears against a portion of inner surface 46 of the base member 2 to provide support to the connection with I-beam 32 which intimately contacts with its support flanges 34,36 against engagement flanges 20,22 of C-shaped member 4.

Referring more specifically to FIG. 2, a width w of C-shaped member 4 is preferably about 40% to 80% of a width W of the inverted channel-shaped base member 2. The base member 2 and the C-shaped member 4 may each be composed of a material selected from the group consisting of carbon steel, stainless steel, nickel alloy steel, plastic, aluminum, or any other conventional material capable of withstanding the stresses of a mechanical load. The angles $\alpha$ and $\beta$ may each be in the range from 10 to 90 degrees.

Referring again to FIGS. 1 and 2, in another embodiment of the present invention, it will be appreciated that the C-shaped member 4 and the base member 2 may be further mechanically joined by any conventional mechanical device or method such as by welding, mechanical fasteners such as screws, nuts and bolts, and rivets, for example, adhesives, and the like. The C-shaped member 4 may have an inner portion 44 which is suitable for intimate contact and connection with the inner portion 46 of base member 2.

Referring now to FIG. 3, it is generally preferred to attach the refractory material support device 1 to an anchor such as refractory anchor 10, for example, and then attach the support device 1 and supported material to a support structure such as I-beam 32. The refractory anchor 10 is then positioned adjacent to refractory material 47 in order to provide support to refractory material 47. The I-beam 32 may then be connected by any conventional mechanically fastening apparatus or method to a pair of structural columns such as a pair of cross beams including cross-beam 48 and its corresponding cross beam (not shown).

Figure 4:
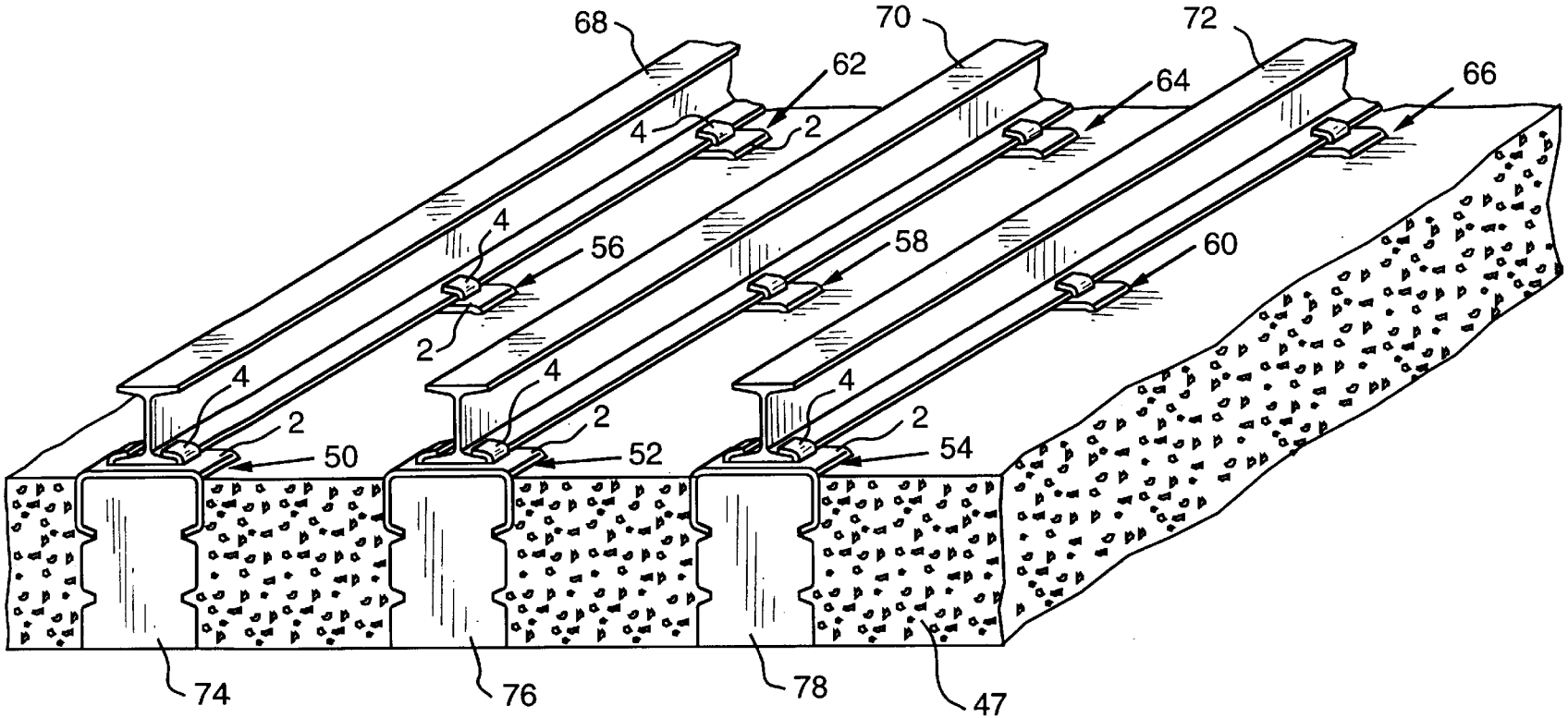
FIG. 4 is a perspective view of a plurality of refractory support devices employed in supporting the ceiling of a furnace.

Referring now to FIG. 4, the supporting device 50 of the present invention may be used in conjunction with at least one other such device such as 52,54,56,58,60,62,64, or 66 to provide a plurality of support devices 50 disposed on a support structure, such as an I-beam 68,70, or 72. These supporting devices 50,56,62 and 52,58,64 and 54,60,66 may be positioned at intervals along the I-beams 68,70, and 72. The supporting devices, such as 50,52,54, for example, may also attach to and serve a force-bearing function for each separate refractory anchor 74,76,78 enclosed within the industrial structure, which may be a furnace.

FIG. 4 shows an embodiment of the present invention in which multiple refractory material support devices 50,52, 54,56,58,60,62,64,66 are used in conjunction with multiple I-beam 68,70,72 structures to support a furnace ceiling.

In a method embodiment of the present invention, referring now to FIGS. 1 and 2, a method for supporting refractory material is provided. At least one inverted channel-shaped generally downwardly open base member 2 is provided with an upper portion 28 and a pair of generally downwardly projecting base flanges 6,8. The base member 2 may have a pair of spaced openings 24,26 disposed within its upper portion 28. Also, at least one generally upwardly open C-shaped member 4 is provided with a pair of generally upwardly projecting engagement flanges 20,22.

Next, referring to FIGS. 1 and 2, the engagement flanges 20,22 of the C-shaped member 4 are passed through the spaced openings 24,26 in the upper portion 28 of the base member 2. The engagement flanges 20,22 of the C-shaped member 4 are then formed at an angle β to provide at least one device 50 for supporting refractory material 47 as shown in FIG. 4. The forming of these engagement flanges 20,22 provides for a nonreleasable engagement between the C-shaped member 4 and the base member 2. In addition, the inner portion 46 of the base member 2 may be further secured to the inner portion 44 of the C-shaped member 4 by conventional mechanical apparatus and methods, such as by welding or mechanical fasteners including screws, nails, nuts and bolts, rivets, adhesives and the like.

Next, referring to FIGS. 1 and 2, refractory anchor 10 is secured to the base flanges 6,8 of the base member 2. Then, one or at least one I-beam 32 having a web 42 and a pair of support flanges 34,36 is provided and the device 1 for supporting refractory material is secured to the support flanges 34,36 of the I-beam 32 by introducing the support flanges 34,36 into a recess formed between the C-shaped member 4 and the base member 2. Finally, the refractory anchor 10 is positioned adjacent to refractory material 47 to support the refractory material 47 (FIG. 3).

In addition, referring to FIG. 4, a plurality of support devices 50,52,54,56,58,60,62,64,66 may be employed with a plurality of I-beams 68,70,72 to support a structure such as a furnace ceiling. Hence, a plurality of the devices 50,52, 54,56,58,60,62,64,66 for supporting refractory material 47 may be provided for the structural support of a plurality of refractory anchors 74,76,78 thereby maintaining the refractory material 47 contained in an industrial structure such as a furnace. For substantially larger furnaces, for example, the number of support devices 50,52,54,56,58,60,62,64,66 may be increased accordingly. For purposes of this method of the present invention, each individual device 50 for supporting refractory material 47 comprising the plurality of devices 50 for supporting refractory material 47 is consistent with the device 1 for supporting refractory material 47 as previously discussed (FIGS. 1 and 2).

It will be understood that words of relative orientation, such as "upper" portion, for example, have been provided for clarity of disclosure and are not intended to limit the scope of the present invention.

It will be appreciated, therefore, that the present invention provides a multi-piece fabrication which has substantial benefits in view of conventional castings used to support refractory material. Technical advantages of the present invention include flexibility of manufacture in adjusting the support device structure to accommodate a variety of dimensional requirements. Other benefits of the present invention include reduced production cycle time and reduced manufacturing costs.

Whereas particular embodiments of the invention have been described, it will be evident to those skilled in the art that numerous variations of the details may be made without departing from the invention as defined in the appended claims.

What is claimed is:

1. A refractory support device for securing refractory material comprising an inverted channel-shaped generally downwardly open base member having an upper portion and a pair of generally downwardly projecting base flanges, said inverted base member having a pair of spaced openings disposed in said upper portion, a generally upwardly open C-shaped member having a pair of upwardly and inwardly projecting engagement flanges passing through said spaced openings, an I-beam having a web and a pair of support flanges being secured to said engagement flanges of said C-shaped member, and, a refractory anchor secured to said base flanges of said base member, said refractory anchor being positioned adjacent to a refractory material to support said refractory material.

2. The device of claim 1, wherein said C-shaped member is secured to said base member by welding.

3. The device of claim 2, wherein said base flanges of said base member are secured to a pair of longitudinal recesses formed in said refractory anchor.

4. The device of claim 1, wherein a width of said C-shaped member is about 40% to 80% of a width of said base member.

5. The device of claim 1, wherein said engagement flanges of said C-shaped member have free end portions which extend generally upwardly and inwardly.

6. The device of claim 1, wherein said base flanges of said base member have free end portions which extend generally downwardly and inwardly.

7. The device of claim 1, wherein an angle with respect to vertical of said base flanges is about 10 to 90 degrees.

8. The device of claim 1, wherein an angle with respect to vertical of said engagement flanges is about 10 to 90 degrees.

9. The device of claim 1, wherein said base member is composed of a material selected from the group consisting of carbon steel, stainless steel, nickel alloy steel, plastic and aluminum.

10. The device of claim 1, wherein said C-shaped member is composed of a material selected from the group consisting of carbon steel, stainless steel, nickel alloy steel, plastic, and aluminum.

11. A refractory support device for securing refractory material to an I-beam having a web and a pair of support flanges comprising an inverted channel-shaped generally downwardly open base member having an upper portion and a pair of generally downwardly projecting base flanges, said inverted base member having a pair of spaced openings disposed in said upper portion, and, a generally upwardly open C-shaped member having a pair of generally upwardly projecting engagement flanges passing through said spaced openings, whereby a refractory material may be supported by said base member which is secured to said C-shaped member which is adapted in turn to be supported by an I-beam.

12. The device of claim 1, wherein a width of said C-shaped member is about 40% to 80% of a width of said base member.

13. The device of claim 1, wherein said engagement flanges of said C-shaped member have free end portions which extend generally upwardly and inwardly.

14. The device of claim 1, wherein said base flanges of said base member have free end portions which extend generally downwardly and inwardly.

15. The device of claim 14, wherein said free end portions are structured to engage and support a refractory anchor.

16. The device of claim 1, wherein an angle with respect to vertical of said base flanges is about 10 to 90 degrees.

17. The device of claim 1, wherein an angle with respect to vertical of said engagement flanges is about 10 to 90 degrees.

18. The device of claim 1, further comprising means for further securing said C-shaped member to said base member.

19. The device of claim 1, wherein said base member is composed of a material selected from the group consisting of carbon steel, stainless steel, nickel alloy steel, plastic, and aluminum.

20. The device of claim 1, wherein said C-shaped member is composed of a material selected from the group consisting of carbon steel, stainless steel, nickel alloy steel, plastic, and aluminum.

21. A method for supporting refractory material comprising providing at least one inverted channel-shaped generally downwardly open base member having an upper portion and a pair of generally downwardly projecting base flanges, said base member having a pair of spaced openings disposed within said upper portion of said base member, providing at least one generally upwardly open C-shaped member having a base wall and a pair of generally upwardly projecting engagement flanges, passing said engagement flanges of said C-shaped member through said spaced openings of said base member, forming said engagement flanges of said C-shaped member to provide at least one device for supporting refractory material having a nonreleasable engagement between said C-shaped member and said base member, securing a refractory anchor to said base flanges of said base member, providing at least one I-beam having a web and a pair of support flanges, securing said device to said support flanges of said I-beam by introducing said support flanges into a recess formed between said C-shaped member and said base member, and positioning said refractory anchor adjacent to said refractory material to support said refractory material.

22. The method of claim 21, wherein said providing at least one I-beam is employing only one said I-beam.

23. The method of claim 21, wherein said providing at least one device is employing a plurality of devices with a plurality of I-beams.

24. The method of claim 23, further including using said plurality of devices with said plurality of I-beams to support a furnace ceiling.

25. A method for assembling a refractory support device comprising, providing an inverted channel-shaped generally downwardly open base member having an upper portion, a pair of generally downwardly projecting base flanges, and a pair of spaced openings disposed within said upper portion of said base member, providing a generally upwardly open C-shaped member having a base wall and a pair of upwardly and inwardly projecting engagement flanges, passing said engagement flanges through said spaced openings, and, forming said engagement flanges at an angle with respect to vertical.

26. The method of claim 25, further comprising securing a refractory anchor to said engagement flanges.

27. The method of claim 25, further comprising securing said C-shaped member to an I-beam.

* * * * *